United States Patent [19]

Gage

[11] Patent Number: 5,024,140

[45] Date of Patent: Jun. 18, 1991

[54] HYDRAULIC CONTROL MECHANISM FOR A HYDRAULIC ACTUATOR

[75] Inventor: Douglas M. Gage, Dubuque, Iowa

[73] Assignee: Deere & Company, Moline, Ill.

[21] Appl. No.: 429,442

[22] Filed: Oct. 30, 1989

[51] Int. Cl.[5] ..... F15B 13/04

[52] U.S. Cl. ..... 91/28; 91/31; 91/461

[58] Field of Search ..... 91/28, 31, 461

[56] References Cited

U.S. PATENT DOCUMENTS

| | | | |
|---|---|---|---|
| 3,987,704 | 10/1976 | Johnson | 91/461 |
| 4,453,451 | 6/1984 | Streeter et al. | 91/28 |
| 4,781,219 | 11/1988 | Haarstad et al. | 60/384 |
| 4,809,586 | 3/1989 | Gage et al. | 91/461 |

OTHER PUBLICATIONS

Specification sheet, 648/7433 Grapple Skidder, John Deere; dated Mar. 1988.

*Primary Examiner*—Edward K. Look

*Assistant Examiner*—F. Daniel Lopez

[57] ABSTRACT

The invention is directed to a hydraulic control mechanism for a work vehicle. The work vehicle is provided with a work implement that is operated by a hydraulic actuator. The positioning of the work actuator is controlled by a pilot control system that supplies a pilot control signal to the end caps of a main hydraulic control valve. The mechanism comprises two pressure sensing valves which control the flow of hydraulic fluid from a fixed displacement pump to move the hydraulic actuator, and the flow of hydraulic fluid from a variable displacement pump to hold the hydraulic actuator. The first pressure sensing valve is used to direct fluid from the variable displacement pump to the hydraulic actuator; whereas the second pressure sensing valve is used to decouple one of the end caps of the main hydraulic control valve from the pilot sensing line so that the main hydraulic control valve is shifted to neutral, and blocking the flow of hydraulic fluid from the fixed displacement pump to the hydraulic control actuator.

13 Claims, 3 Drawing Sheets

FIG. 1
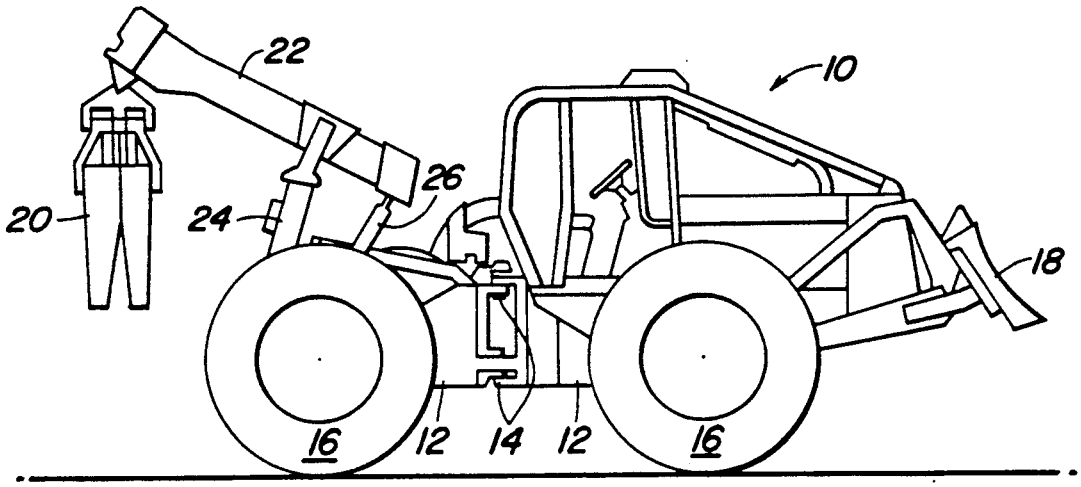
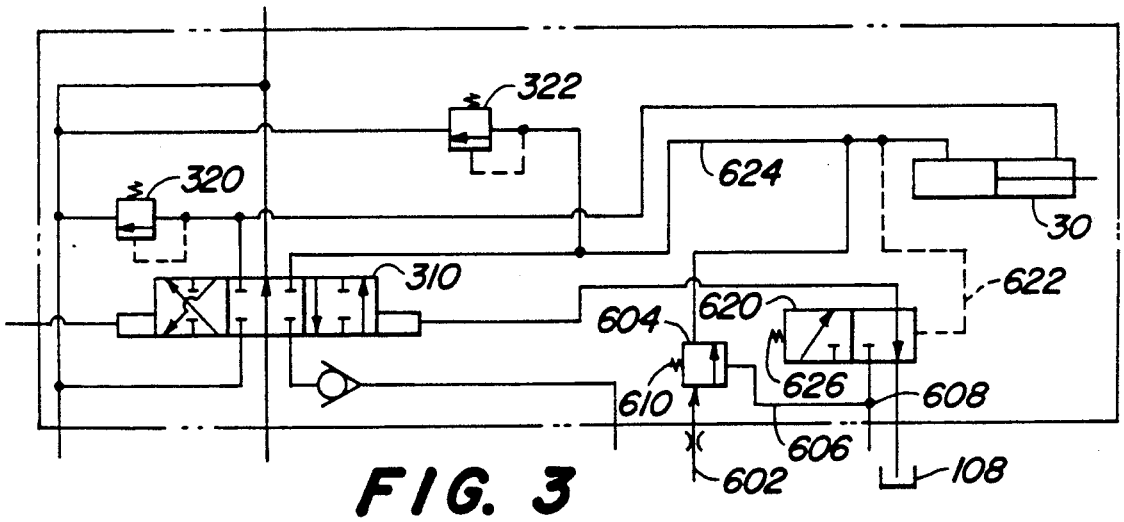
FIG. 3
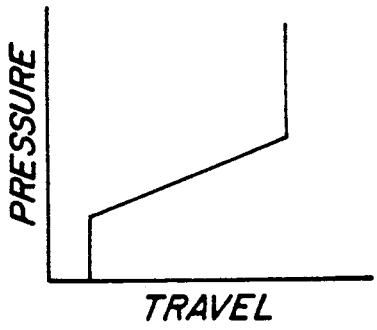
FIG. 4

HYDRAULIC CONTROL MECHANISM FOR A HYDRAULIC ACTUATOR

BACKGROUND OF THE INVENTION

1. Field of the Invention

The invention is directed to a hydraulic control mechanism for actuating a hydraulic actuator using the output of a fixed displacement pump and holding the hydraulic actuator in a selected position using the output of a variable displacement pump.

2. Description of the Prior Art

Work vehicles are provided with working implements that are manipulated by hydraulic cylinders or actuators. With a grapple skidder, the working implement is a pair of tongs that are manipulated by one or more hydraulic actuators. The tongs are supported from a grapple arch which may be coupled to a pivoting boom. Both the grapple arch and boom are provided with hydraulic actuators for controlling the position of the grapple relative to the skidder.

The 648D grapple skidder, manufactured and marketed by the assignee of the present application, is similar to the skidder described above in that it is provided with a grapple arch and boom for positioning the grapple. A single hydraulic actuator manipulates the grapple. This actuator is hydraulically coupled through a control valve assembly to a variable displacement pump. The variable displacement pump directs hydraulic fluid as needed to the grapple.

SUMMARY OF THE INVENTION

The present invention is directed to a work vehicle, such as a skidder, having both a variable displacement pump and a fixed displacement pump for supplying hydraulic fluid to the hydraulic working actuators. Fixed displacement pumps offer faster response than typical variable displacement pumps. However, variable displacement pumps are usually more energy efficient than fixed displacement pumps.

The present invention comprises a hydraulic detent that takes advantage of the features of both of these pumps. With the present invention the fixed displacement pump is used to close the grapple while the variable displacement pump is used to hold the grapple in its closed position. This is accomplished by using two pressure sensing valves. The first pressure sensing valve is hydraulically positioned between the variable displacement pump and the hydraulic actuator of the grapple. The pressure sensing line of the first valve is coupled to the pilot pressure signal line at a sensing point. As the hydraulic pressure increases in the pilot pressure signal line, the spring biased first pressure sensing valve is opened directing hydraulic fluid from the variable displacement pump to the hydraulic actuator. The second pressure sensing valve is hydraulically positioned between the sensing point on the pilot pressure signal line and one end cap on the pilot controlled main hydraulic control valve. The second pressure sensing valve is a spring biased closed center valve. The second pressure sensing valve is a spring biased closed center valve that selectively couples the end cap of the main hydraulic control valve to sump when hydraulic pressure directed to the hydraulic actuator exceeds a preselected level.

In operation, when grabbing logs and closing the grapple, the operator manipulates a control lever positioning a pilot control valve to direct a pilot fluid signal to one of the end caps of the main hydraulic control valve shifting the main hydraulic control valve. The main hydraulic control valve controls fluid flow from the fixed displacement pump to the hydraulic actuator. The main hydraulic control valve is a three-position open center valve. The operator, when grabbing and holding the logs would put the operator's lever into detent which holds the pilot control valves open to continually direct the pilot fluid signal to the main control valve end cap. As the logs are grabbed and brought together, hydraulic pressure increases in the hydraulic actuator line. After this hydraulic pressure increases over a preselected level the second pressure sensing valve is shifted decoupling the end cap from the pilot pressure and dumping the end cap to sump. As the end cap is depressurized, the main hydraulic control valve recenters and no longer directs fluid from the fixed displacement pump to the hydraulic actuator.

In the meantime, the pilot fluid pressure signal has opened the first pressure sensing valve directing hydraulic fluid from the variable displacement pump to the hydraulic actuator augmenting fluid flow from the fixed displacement pump. Therefore, as the fixed displacement pump is decoupled from the hydraulic actuator, the variable displacement pump still maintains hydraulic pressure at the actuator, thereby holding the grapple in a closed configuration.

If the load shifts in the grapple, hydraulic pressure in the hydraulic actuator line may decrease below the preselected pressure level thereby reshifting the second pressure sensing valve and recoupling the main hydraulic control valve end cap to the pilot pressure signal line. The main hydraulic control valve would then reshift to apply hydraulic fluid from the fixed displacement pump to the hydraulic actuator until the pressure in the hydraulic actuator line had again reached the preselected level.

BRIEF DESCRIPTION OF THE DRAWINGS

FIG. 1 is a side view of a grapple skidder.

FIG. 3 is a hydraulic schematic of the present invention.

FIG. 4 is a graph of hydraulic pressure in the hydraulic actuator line versus travel of the hydraulic actuator when the grapple is loading.

DETAILED DESCRIPTION

Work Vehicle

Figure 2A:
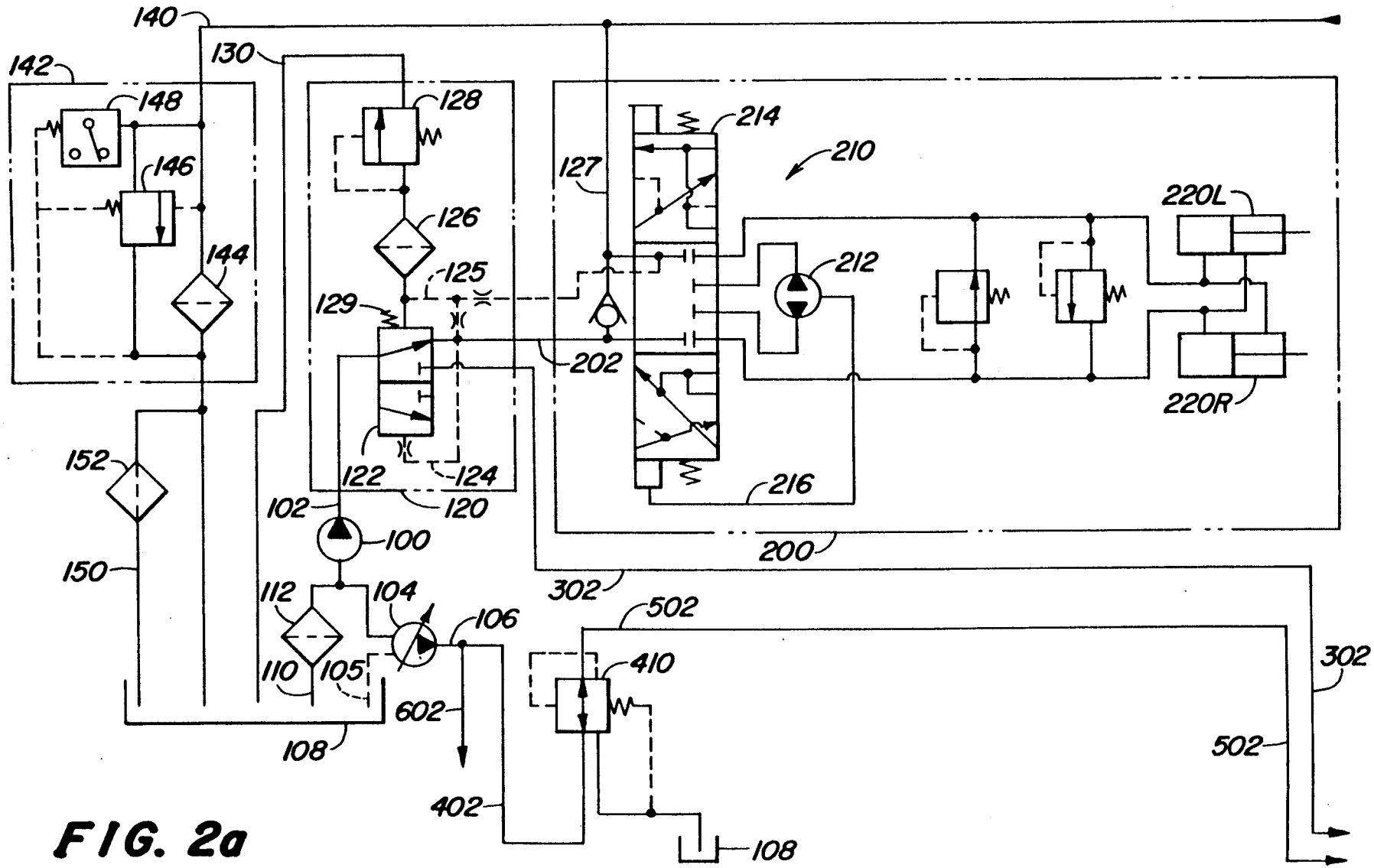
FIGS. 2*a* and 2*b* are hydraulic schematics of the hydraulic system of a work vehicle using the present invention.

FIG. 1 illustrates a grapple skidder for which this invention is particularly well suited. However, this invention can be used with any work vehicle having hydraulic actuators for performing a work operation.

Grapple skidder 10 comprises an articulated frame 12 that is articulated about vertical pivots 14. The skidder is provided with ground engaging means 16 comprising wheels which support and propel the skidder. A dozer blade 18 extends from and is operatively coupled to the skidder. A grapple 20 is attached to boom 22 located at the rear of the skidder. The boom is mounted on grapple arch 24 and is manipulated relative to the grapple arch by hydraulic actuators 26. The grapple arch is manipulated relative to the skidder by hydraulic actuators 28 schematically illustrated in FIG. 2*b*. The tongs of the grapple itself are opened and closed by hydraulic actuator 30, schematically illustrated in FIGS. 2*b* and 3.

Hydraulic System

Figure 2B:
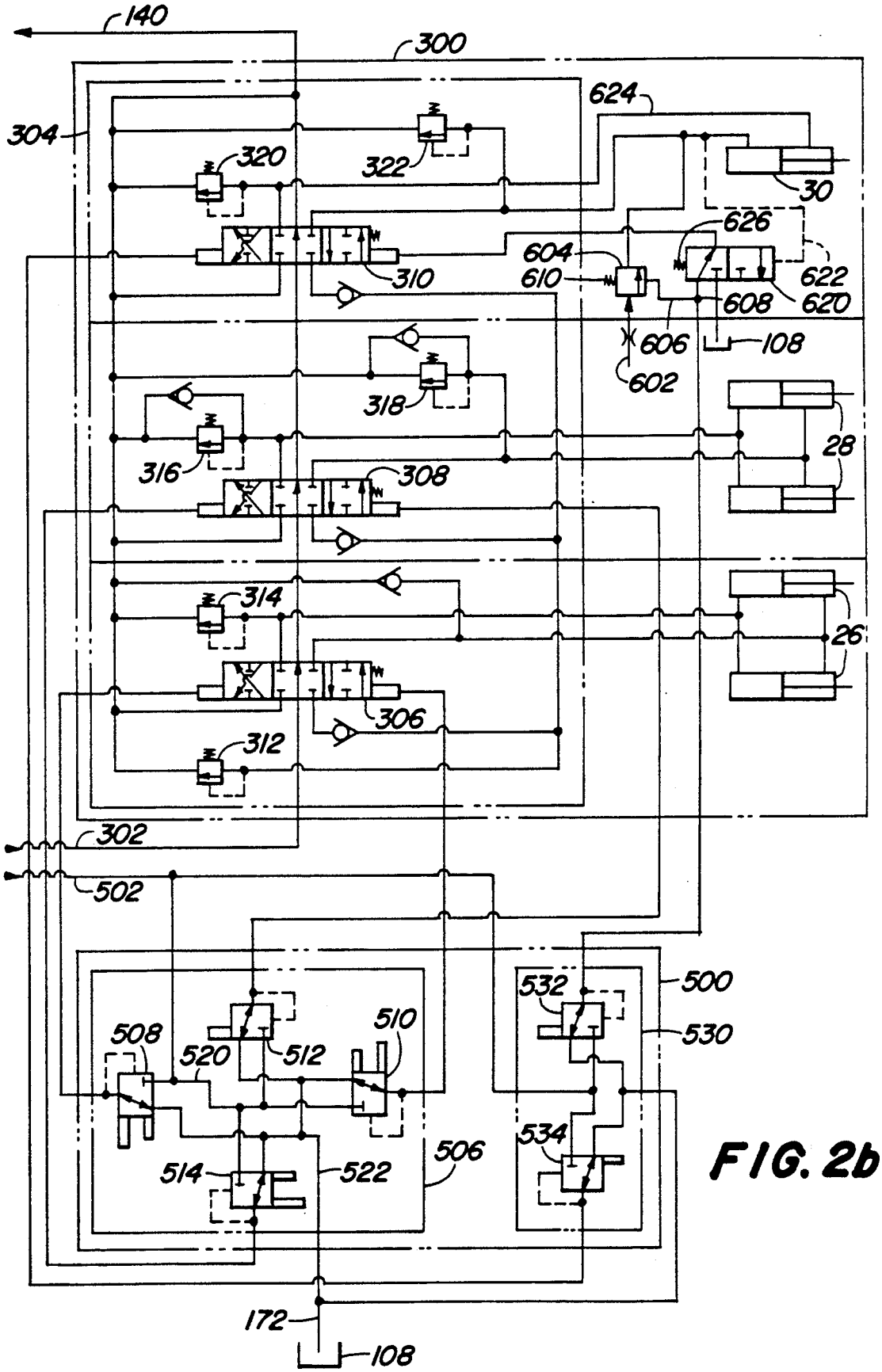

The overall hydraulic system is schematically illustrated in FIGS. 2A and 2B, comprising an open center hydraulic system and a closed center hydraulic system. A similar hydraulic system for a loader is disclosed in U.S. Pat. No. 4,809,586, assigned to the present assignee and incorporated herein by reference. The open center hydraulic system is provided with hydraulic fluid by fixed displacement pump 100 which pumps hydraulic fluid through hydraulic line 102. The closed center hydraulic system is provided with hydraulic fluid by variable displacement pump 104 which is provided with a pressure sensing and compensating assembly for maintaining constant pressure in hydraulic line 106. Pump 104 is also provided with drain path 105 for returning leaking hydraulic fluid back to the sump. Both pumps are operatively interconnected in a piggybacked fashion to provide a compact pumping unit. The pumps are driven by the internal combustion engine through a suitable mechanical coupling.

The pumps draw hydraulic fluid from common sump 108 through a common hydraulic fluid suction line 110. Line 110 is provided with screen 112 for removing large particulates from the hydraulic fluid being directed to pumps 100 and 104.

The hydraulic fluid output of pump 100 is directed through line 102 to priority valve assembly 120 which prioritizes fluid flow between steering assembly 200 and the grapple and grapple arch assembly which is fluidly coupled to line 302. The priority valve assembly gives priority to the steering assembly, shutting off hydraulic fluid flow to the loader assembly in response to fluid demands of the steering assembly. The priority valve assembly comprises a spring biased two-position spool 122 that selectively directs fluid between the steering and loader assemblies. Spool 122 is hydraulically balanced between restricted hydraulic pressure sensing lines 124 and 125. When steering valve 210 is centered in a neutral position, hydraulic flow from supply line 202 through valve 210 is stopped, increasing hydraulic pressure in line 202 and sensing line 124. In the centered position, valve 210 couples sensing line 125 to sump return line 140 through line 127 reducing hydraulic pressure in sensing line 125. As such, the increased hydraulic pressure in line 124 overcomes the hydraulic pressure in line 125 and the biasing force of spring 129 to position spool 122 so that it can transmit hydraulic fluid to grapple and grapple arch assembly supply line 302.

The priority valve assembly is also provided with a filter 126 and pressure relief valve 128 through which hydraulic fluid can be directed to sump return line 130. The sump return line receives hydraulic fluid from sensing line 125.

Hydraulic fluid exhausted from steering assembly 200 and the grapple and grapple arch assembly is directed by sump return line 140 to sump 108. Sump return line 140 is provided with a return filter assembly 142 having filter 144, hydraulically balanced pressure relief valve 146 and hydraulically balanced pressure sensitive electrical switch 148. Hydraulic fluid is typically filtered by the filter and returned to sump 108. However, as the filter collects foreign material, the hydraulic pressure drop across the filter increases, closing electrical switch 148. Upon the closing of electrical switch 148, an indicator light is triggered in the operator cab of the skidder, alerting the operator that filter 144 should be cleaned or replaced. As the pressure drop continues to increase because of additional foreign material collected on the filter, pressure relief valve 146 opens thereby providing a hydraulic flow path that bypasses the filter.

Hydraulic fluid sump return line 150 located downstream of the filter assembly is provided with oil cooler 152 for cooling oil being returned to sump 108.

Steering assembly 200 receives hydraulic fluid through hydraulic line 202 from priority valve assembly 120. The hydraulic fluid is directed to infinitely variable steering control valve 210. The main fluid path from the valve directs hydraulic fluid to steering hydraulic motors or cylinders 220L and 220R for assisting in steering the skidder. Control valve 210 comprises fluid meter 212 and valve structure 214 which are operatively coupled to one another by mechanical follow up connection 216. Valve structure 214 comprises a main fluid path and may comprise a dampening fluid path. The dampening fluid path comprises a number of restricted passages that are used to dampen pressure spikes in the main fluid path. The steering control valve is more fully explained in U.S. Pat. No. 4,781,219, in which the present inventor is one of the joint inventors therein, and which is incorporated herein by reference.

Hydraulic fluid is directed to the working circuit through hydraulic line 302. Working circuit 300 comprises working control valve package 304 having three pilot controlled directional control valves 306, 308 and 310 with associated pressure relief valves 312, 314, 316, 318, 320 and 322. The directional control valves control the movement of the three hydraulic actuators which include boom-tilt actuators 26, grapple arch tilt actuators 28, and grapple actuator 30. All the control valves are positioned by pilot control assembly 500 which will be discussed in more detail below.

Hydraulic fluid is directed from pump 104 through supply line 402 to pressure reducing valve 410. The pressure reducing valve maintains a constant reduced output pressure in pilot supply line 502.

The pilot control system comprises two valve packages that hydraulically control the positioning of loader control valves 306, 308 and 310. The control system provides hydraulic inputs to the end caps of the valves for hydraulically shifting the valves. Hydraulic fluid from pressure reducing valve 410 is directed to the pilot control system through line 502 and hydraulic fluid is returned to sump 108 through sump return line 172.

First valve package 506 is provided with four two-position valves 508, 510, 512 and 514 that are arranged in opposed pairs. The first opposed pair 508 and 510 control the positioning of boom-tilt valve 306, whereas the second opposed pair 512 and 514 control the positioning of grapple arch tilt valve 308. Fluid from line 502 is directed to shared hydraulic supply line 520 to which each of the four valves is fluidically coupled. In addition, each of the four valves is fluidically coupled to shared sump return line 522 that is in fluid communication with sump return line 172.

The positioning of the four valves may be manually controlled by the operator through a joystick arrangement. As the joystick is moved backward, valve 508 is positioned to direct hydraulic fluid from shared hydraulic line 520 to the left side and end cap of valve 306. At the same time, valve spool 510 fluidically couples the right side end cap of valve 306 to shared sump line 522. In this way, valve 306 is moved to the right so that hydraulic fluid from supply line 302 extends boom-tilt actuator 26 pivoting the boom relative to the grapple arch. The grapple arch tilt actuator is controlled in a similar manner, by the left and right movement of the joystick controller.

Second valve package 530 is provided with a single pair of two-position valves 532 and 534 that are manipulated by a separate control lever. The second valve package is used for controlling the positioning of control valve 310. Valve 310 controls the flow of hydraulic fluid to grapple actuator 30. Therefore, by manipulating valve package 530, the extension and retraction of hydraulic actuator 30 is controlled by the operator.

Hydraulic Detent

The hydraulic detent of the present invention is best illustrated in FIG. 3 and is formed by two pressure sensing valves. The first pressure sensing valve 604 is hydraulically positioned between the variable displacement pump 104 or a second source of pressurized hydraulic fluid, and hydraulic actuator 30 along restricted hydraulic line 602. Valve 604 regulates the flow of hydraulic fluid from the variable displacement pump to the hydraulic actuator. Valve 604 is provided with a first pressure sensing line 606 that is hydraulically coupled to pilot signal line 536 of the second pilot valve package 530. Sensing line 606 is coupled to pilot signal line 536 at sensing point 608. Therefore, a pilot pressure signal in line 536 is directed through sensing line 606 to valve 604 for driving valve 604 against spring 610 opening the valve and directing hydraulic fluid from line 602 of pump 104 to hydraulic actuator 30.

The second pressure sensing valve 620 is a two-way two-position valve that is hydraulically positioned between sensing point 608 on pilot pressure line 536 and the right end cap on the main hydraulic control valve 310. Pressure sensing valve 620 is used for coupling and decoupling the pilot signal from the right end cap of the main hydraulic control valve 310. Valve 620 is provided with a second pressure sensing line 622 that is hydraulically coupled to the first hydraulic line 624. The first hydraulic line 624 is used for directing fluid from main hydraulic control valve 310 to actuator 30. Pressurized fluid from fixed displacement pump 100, the first source of pressurized fluid, is directed to valve 310 through line 302, and from valve 310 to actuator 30 through line 624.

As illustrated graphically in FIG. 4, as the grapple closes (travel) hydraulic pressure increases in first hydraulic line 624. As pressure sensing line 622 is hydraulically coupled to line 624 the hydrdaulic pressure also increases in this line. Both variable displacement pump 104 through valve 604 and fixed displacement pump 100 through valve 310 may simultaneously or sequentially direct pressurized hydraulic fluid to actuator 30. As hydraulic pressure increases in sensing line 622 valve 620 is shifted against spring 626 decoupling the right end cap from the pilot signal line and dumping hydraulic fluid in the end cap to sump. Such a valve shift is illustrated in FIG. 3. As such, valve 310 reshifts to neutral decoupling pump 100 from actuator 30. As the pilot signal is still being applied because the operator lever is in detent, the first pressure valve is still open for directing pressurized hydraulic fluid from pump 104 to actuator 30.

If the load shifts in the grapple, the hydraulic pressure in line 624 may decrease below the preselected pressure level. In such a situation, valve 620 is reshifted so that pilot pressure line 536 is coupled to the right end cap repositioning valve 310 for directing fluid from pump 100 to actuator 30. As the pressure again increases above the preselected level, pump 100 would again be decoupled from actuator 30 by valve 310, as discussed above.

It should be noted that fixed displacement pump 100 and valve 310 are part of an open center hydraulic system, whereas variable displacement pump 104 is part of a closed center hydraulic system.

I claim:

1. A hydraulic control mechanism comprising:

a first source of pressurized hydraulic fluid;

a hydraulic actuator;

a first hydraulic line hydraulically coupling the first source to the hydraulic actuator;

a pilot signal line for transmitting a hydraulic pilot signal, the pilot signal line having a pilot pressure sensing point;

a pilot operated hydraulic control valve hydraulically positioned between the first source and the hydraulic actuator on the first hydraulic line, the hydraulic control valve regulating the flow of hydraulic fluid from the first source to the hydraulic actuator, the hydraulic control valve having at least one end cap hydraulically coupled to the pilot signal line for positioning the hydraulic control valve in response to a pilot signal;

a second source of pressurized hydraulic fluid;

a second hydraulic line hydraulically coupling the second source to the hydraulic actuator;

a first pressure sensing valve hydraulically positioned between the second source and the hydraulic actuator on the second hydraulic line, the first pressure sensing valve regulating the flow of hydraulic fluid from the second source to the hydraulic actuator, the first pressure sensing valve is provided with a first pressure sensing line that is hydraulically coupled to the pilot signal line at the pilot pressure sensing point for positioning the first pressure sensing valve in response to a pilot signal; and a second pressure sensing valve hydraulically positioned between the sensing point on the pilot sensing line and the at least one end cap of the hydraulic control valve for coupling and decoupling the pilot signal to the end cap of the hydraulic control valve, the second pressure sensing valve is provided with a second pressure sensing line that is hydraulically coupled to the first hydraulic line for driving the second pressure sensing valve in response to the hydraulic pressure in the first hydraulic line, whereby when hydraulic pressure increases in the first hydraulic line the second pressure sensing valve shifts decoupling the at least one end cap of the hydraulic control valve from the pilot pressure signal.

2. A hydraulic control mechanism as defined by claim 1 wherein the pilot signal line is coupled to source of pilot pressure having a pilot control actuator that is provided with a detent position for continually pressuring the at least one end cap of the hydraulic control valve.

3. A hydraulic control mechanism as defined by claim 2 wherein the first source of pressurized hydraulic fluid is a fixed displacement pump and the second source of pressurized fluid is a variable displacement pump.

4. A hydraulic control mechanism as defined by claim 3 wherein the second pressure sensing line of the second pressure sensing valve is coupled to the first hydraulic line between the hydraulic actuator and the hydraulic control valve.

5. A hydraulic control mechanism as defined by claim 4 wherein the second pressure sensing valve is a two-position two-way hydraulic valve that is spring biased to normally direct the pilot signal to the at least one end cap of the hydraulic control valve.

6. A hydraulic control mechanism as defined by claim 5 wherein the first pressure sensing valve is spring biased to normally prevent the flow of fluid from the second source of pressurized fluid to the hydraulic actuator.

7. A work vehicle for performing a work operation, the vehicle comprising:

a support structure;

ground engaging means coupled to the supporting structure for supporting and propelling the supporting structure;

a working implement mounted to the supporting structure for performing a work operation;

a hydraulic actuator operatively coupled to the supporting structure and the work implement for controlling the work implement;

a pilot control means for controlling the operation of the hydraulic actuator, the pilot control means having an operator lever which is coupled to hydraulic valve for directing a hydraulic pilot signal through a pilot signal line, the pilot signal line having a pressure sensing point, the pilot control means is provided with a detent for the operator lever for providing a continuous hydraulic pilot signal;

a first source of pressurized hydraulic fluid is mounted to the supporting structure;

a first hydraulic line hydraulically coupling the first source to the hydraulic actuator;

a hydraulic control valve hydraulically positioned between the first source and the hydraulic actuator on the first hydraulic line, the hydraulic control valve regulating the flow of hydraulic fluid from the first source to the hydraulic actuator, the hydraulic control valve having at least one end cap hydraulically coupled to the pilot signal line for positioning the hydraulic control valve in response to a pilot signal;

a second source of pressurized hydraulic fluid;

a second hydraulic line hydraulically coupling the second source to the hydraulic actuator;

a first pressure sensing valve hydraulically positioned between the second source and the hydraulic actuator on the second hydraulic line, the first pressure sensing valve regulating the flow of hydraulic fluid from the second source to the hydraulic actuator, the first pressure sensing valve is provided with a first pressure sensing line that is hydraulically coupled to the pilot signal line at the pilot pressure sensing point for positioning the first pressure sensing valve in response to a pilot signal; and a second pressure sensing valve hydraulically positioned between the sensing point on the pilot sensing line and the at least one end cap of the hydraulic control valve for coupling and decoupling the pilot signal to the end cap of the hydraulic control valve, the second pressure sensing valve is provided with a second pressure sensing line that is hydraulically coupled to the first hydraulic line for driving the second pressure sensing valve in response to the hydraulic pressure in the first hydraulic line, whereby when hydraulic pressure increases in the first hydraulic line the second pressure sensing valve shifts decoupling the at least one end cap of the hydraulic control valve from the pilot pressure signal.

8. A work vehicle as defined by claim 7 wherein the first source of pressurized hydraulic fluid is a fixed displacement pump and the second source of pressurized fluid is a variable displacement pump.

9. A work vehicle as defined by claim 8 wherein the second pressure sensing line of the second pressure sensing valve is coupled to the first hydraulic line between the hydraulic actuator and the hydraulic control valve.

10. A work vehicle as defined by claim 9 wherein the second pressure sensing valve is a two-position, two-way hydraulic valve that is spring biased to normally direct the pilot signal to the at least one end cap of the hydraulic control valve.

11. A work vehicle as defined by claim 10 wherein the first pressure sensing valve is spring biased to normally prevent the flow of fluid from the second source of pressurized fluid to the hydraulic actuator.

12. A work vehicle as defined by claim 11 wherein the hydraulic control valve is a four-way three position valve.

13. A work vehicle as defined by claim 12 further comprising a hydraulic sump and the second pressure sensing valve is operatively coupled to a sump return line for directing hydraulic fluid to the sump, the at least one end cap is hydraulically coupled to the sump through the sump return line when the at least one end cap is decoupled from the pressure signal.

* * * * *